US009052652B2

(12) United States Patent
Fujii et al.

(10) Patent No.: US 9,052,652 B2
(45) Date of Patent: Jun. 9, 2015

(54) FIXING DEVICE INCLUDING A FRICTION REDUCER AND AN IMAGE FORMING APPARATUS INCLUDING THE FIXING DEVICE

(71) Applicants: Tomohiko Fujii, Hyogo (JP); Shigeo Nanno, Kyoto (JP); Minoru Toyoda, Hyogo (JP); Hitoshi Fujiwara, Osaka (JP); Tomoya Adachi, Hyogo (JP); Yasuharu Kawarasaki, Osaka (JP)

(72) Inventors: Tomohiko Fujii, Hyogo (JP); Shigeo Nanno, Kyoto (JP); Minoru Toyoda, Hyogo (JP); Hitoshi Fujiwara, Osaka (JP); Tomoya Adachi, Hyogo (JP); Yasuharu Kawarasaki, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/084,902

(22) Filed: Nov. 20, 2013

(65) Prior Publication Data

US 2014/0153983 A1 Jun. 5, 2014

(30) Foreign Application Priority Data

Dec. 4, 2012 (JP) ..... 2012-265371

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2007; G03G 15/2053; G03G 15/2064; G03G 2215/2016; G03G 2215/2035
USPC ..... 399/329, 328
See application file for complete search history.

(56) References Cited

U.S. PATENT DOCUMENTS

| | | | | |
|---|---|---|---|---|
| 2010/0202809 | A1 | 8/2010 | Shinshi et al. | 399/329 |
| 2010/0296849 | A1* | 11/2010 | Yamamoto et al. | 399/329 |
| 2011/0116848 | A1* | 5/2011 | Yamaguchi et al. | 399/329 |
| 2012/0177422 | A1 | 7/2012 | Nanno et al. | 399/329 |
| 2012/0275833 | A1* | 11/2012 | Ishida et al. | 399/329 |
| 2012/0275834 | A1 | 11/2012 | Naitoh et al. | 399/329 |
| 2013/0064586 | A1 | 3/2013 | Adachi et al. | 399/329 |
| 2013/0236224 | A1* | 9/2013 | Matsumoto et al. | 399/329 |
| 2013/0308990 | A1* | 11/2013 | Samei et al. | 399/329 |
| 2014/0016972 | A1* | 1/2014 | Seshita et al. | 399/329 |
| 2014/0056625 | A1* | 2/2014 | Naitoh et al. | 399/329 |
| 2014/0064804 | A1* | 3/2014 | Yamaguchi et al. | 399/329 |
| 2014/0072354 | A1* | 3/2014 | Toyoda et al. | 399/329 |
| 2014/0093288 | A1* | 4/2014 | Naitoh et al. | 399/329 |
| 2014/0099146 | A1* | 4/2014 | Fujii et al. | 399/122 |
| 2014/0112691 | A1* | 4/2014 | Nanno et al. | 399/329 |

* cited by examiner

FOREIGN PATENT DOCUMENTS

| | | |
|---|---|---|
| JP | 2010-164999 | 7/2010 |
| JP | 2010-181821 | 8/2010 |
| JP | 2012-145633 | 8/2012 |

*Primary Examiner* — Sophia S Chen
(74) *Attorney, Agent, or Firm* — Harness, Dickey & Pierce, P.L.C.

(57) ABSTRACT

A fixing device includes a nip formation pad disposed opposite an inner circumferential surface of an endless belt and pressing the endless belt against a pressing rotary body to form a fixing nip between the endless belt and the pressing rotary body. A recording medium is conveyed through the fixing nip. The endless belt slides over a friction reducer sandwiched between the endless belt and the nip formation pad. The friction reducer includes a body and at least one tab projecting from the body in a direction opposite a recording medium conveyance direction. A friction reducer fastener is attached to the tab of the friction reducer and placed inside the nip formation pad to mount the friction reducer on the nip formation pad.

20 Claims, 5 Drawing Sheets

FIXING DEVICE INCLUDING A FRICTION REDUCER AND AN IMAGE FORMING APPARATUS INCLUDING THE FIXING DEVICE

CROSS-REFERENCE TO RELATED APPLICATION

This patent application is based on and claims priority pursuant to 35 U.S.C. §119 to Japanese Patent Application No. 2012-265371, filed on Dec. 4, 2012, in the Japanese Patent Office, the entire disclosure of which is hereby incorporated by reference herein.

BACKGROUND

1. Technical Field

Example embodiments generally relate to a fixing device and an image forming apparatus, and more particularly, to a fixing device for fixing a toner image on a recording medium and an image forming apparatus incorporating the fixing device.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include an endless belt having a decreased thermal capacity to shorten a warm-up time taken to warm up the fixing device to a desired fixing temperature and a first print time taken to output the first recording medium bearing the fixed toner image upon receipt of a print job.

For example, the belt is formed into a loop inside which a stationary nip formation pad is situated. A pressing roller situated outside the loop formed by the belt is pressed against the nip formation pad via the belt to form a fixing nip between the pressing roller and the belt. As the belt and the pressing roller rotate and convey the recording medium through the fixing nip, the belt and the pressing roller apply heat and pressure to the recording medium, fixing the toner image on the recording medium.

Since the pressing roller presses the belt against the nip formation pad, as the belt rotates, it slides over the nip formation pad frictionally, resulting abrasion of the belt and the nip formation pad. To address this problem, a low-friction sheet having a decreased friction coefficient may be interposed between the belt and the nip formation pad. For example, JP-2010-181821-A discloses the low-friction sheet sandwiched between the belt and the nip formation pad so that the belt slides over the nip formation pad via the low-friction sheet. The low-friction sheet covering the nip formation pad is secured to the nip formation pad with a plate spring and a screw. The low-friction sheet reduces friction between the belt and the nip formation pad, suppressing abrasion of the belt and the nip formation pad.

However, the plate spring and the screw may occupy a substantial space which upsizes the fixing device and complicate assembly of the fixing device which increases manufacturing costs.

SUMMARY

At least one embodiment provides a novel fixing device that includes an endless belt rotatable in a given direction of rotation, a heater disposed opposite and heating the endless belt, and a pressing rotary body rotatable while contacting the endless belt. A nip formation pad is disposed opposite an inner circumferential surface of the endless belt and presses the endless belt against the pressing rotary body to form a fixing nip between the endless belt and the pressing rotary body. A recording medium is conveyed through the fixing nip. The endless belt slides over a friction reducer sandwiched between the endless belt and the nip formation pad. The friction reducer includes a body and at least one tab projecting from the body in a direction opposite a recording medium conveyance direction. A friction reducer fastener is attached to the tab of the friction reducer and placed inside the nip formation pad to mount the friction reducer on the nip formation pad.

At least one embodiment provides a novel image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
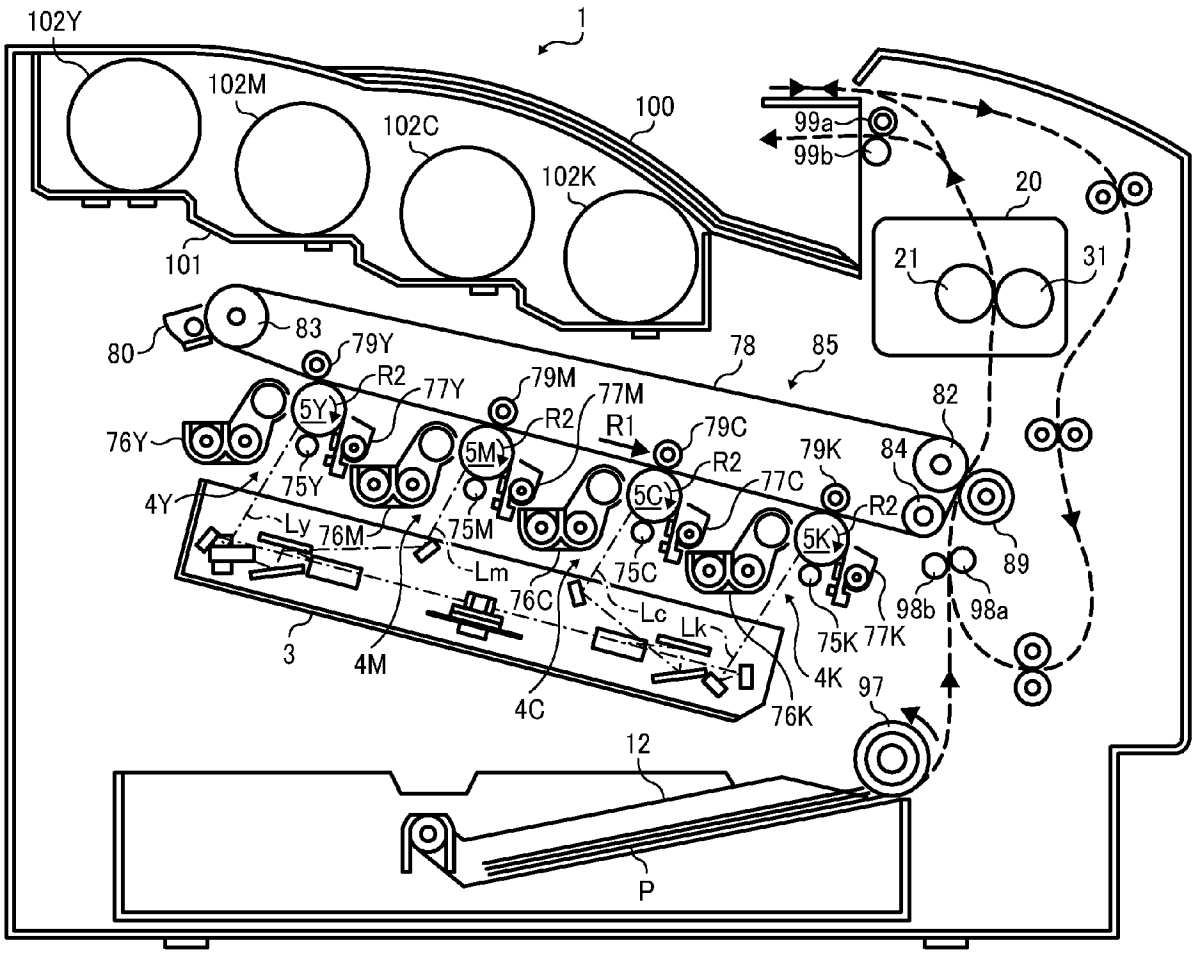
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1 is a tandem color printer that forms color and monochrome toner images on recording media by electrophotography.

As shown in FIG. 1, the image forming apparatus 1 includes four image forming devices 4Y, 4M, 4C, and 4K that form yellow, magenta, cyan, and black toner images, respectively; a paper tray 12 situated below the image forming devices 4Y, 4M, 4C, and 4K; an intermediate transfer unit 85 situated above the image forming devices 4Y, 4M, 4C, and 4K; a fixing device 20 situated above the intermediate transfer unit 85; and a bottle holder 101 situated above the intermediate transfer unit 85.

The bottle holder 101 disposed in an upper portion of the image forming apparatus 1 holds four toner bottles 102Y, 102M, 102C, and 102K containing fresh yellow, magenta, cyan, and black toners, respectively, and detachably attached to the bottle holder 101.

The intermediate transfer unit 85 situated below the bottle holder 101 includes an intermediate transfer belt 78, four primary transfer bias rollers 79Y, 79M, 79C, and 79K, a secondary transfer backup roller 82, a cleaning backup roller 83, a tension roller 84, and an intermediate transfer belt cleaner 80.

The image forming devices 4Y, 4M, 4C, and 4K are disposed opposite the intermediate transfer belt 78 and aligned along a rotation direction R1 of the intermediate transfer belt 78. The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, cleaners 77Y, 77M, 77C, and 77K, and dischargers, respectively.

A detailed description is now given of image forming processes performed on the photoconductive drums 5Y, 5M, 5C, and 5K.

A driver (e.g., a motor) drives and rotates the photoconductive drums 5Y, 5M, 5C, and 5K clockwise in FIG. 1 in a rotation direction R2. The image forming devices 4Y, 4M, 4C, and 4K perform image forming processes including a charging process, an exposure process, a development process, a primary transfer process, and a cleaning process on the photoconductive drums 5Y, 5M, 5C, and 5K as the photoconductive drums 5Y, 5M, 5C, and 5K rotate clockwise in FIG. 1 in the rotation direction R2.

In the charging process, the chargers 75Y, 75M, 75C, and 75K disposed opposite the photoconductive drums 5Y, 5M, 5C, and 5K, respectively, uniformly charge an outer circumferential surface of the respective photoconductive drums 5Y, 5M, 5C, and 5K.

In the exposure process, an exposure device 3 disposed opposite the photoconductive drums 5Y, 5M, 5C, and 5K emits laser beams Ly, Lm, Lc, and Lk onto the charged outer circumferential surface of the respective photoconductive drums 5Y, 5M, 5C, and 5K. The laser beams Ly, Lm, Lc, and Lk scan and expose the outer circumferential surface of the respective photoconductive drums 5Y, 5M, 5C, and 5K, forming electrostatic latent images thereon according to yellow, magenta, cyan, and black image data of color image data sent from an external device such as a client computer.

In the development process, the development devices 76Y, 76M, 76C, and 76K disposed opposite the photoconductive drums 5Y, 5M, 5C, and 5K visualize the electrostatic latent images formed on the photoconductive drums 5Y, 5M, 5C, and 5K with yellow, magenta, cyan, and black toners supplied from the toner bottles 102Y, 102M, 102C, and 102K into yellow, magenta, cyan, and black toner images, respectively.

The photoconductive drums 5Y, 5M, 5C, and 5K are disposed opposite the primary transfer bias rollers 79Y, 79M, 79C, and 79K via the intermediate transfer belt 78 to form primary transfer nips between the intermediate transfer belt 78 and the photoconductive drums 5Y, 5M, 5C, and 5K, respectively. In the primary transfer process, the primary transfer bias rollers 79Y, 79M, 79C, and 79K primarily transfer the yellow, magenta, cyan, and black toner images formed on the photoconductive drums 5Y, 5M, 5C, and 5K onto the intermediate transfer belt 78.

After the primary transfer process, a slight amount of residual toner failed to be transferred onto the intermediate transfer belt 78 remains on the photoconductive drums 5Y, 5M, 5C, and 5K. To address this circumstance, in the cleaning process, a cleaning blade of the respective cleaners 77Y, 77M, 77C, and 77K disposed opposite the photoconductive drums 5Y, 5M, 5C, and 5K mechanically collects the residual toner from the photoconductive drums 5Y, 5M, 5C, and 5K, respectively.

Finally, the dischargers disposed opposite the photoconductive drums 5Y, 5M, 5C, and 5K remove residual potential from the photoconductive drums 5Y, 5M, 5C, and 5K, respectively.

After the image forming processes described above, a color toner image is formed on the intermediate transfer belt 78. The intermediate transfer belt 78 is stretched taut across and supported by the secondary transfer backup roller 82, the cleaning backup roller 83, and the tension roller 84. The four primary transfer bias rollers 79Y, 79M, 79C, and 79K and the photoconductive drums 5Y, 5M, 5C, and 5K sandwich the intermediate transfer belt 78 to form the primary transfer nips between the photoconductive drums 5Y, 5M, 5C, and 5K and the intermediate transfer belt 78. A transfer bias having a polarity opposite a polarity of toner is applied to the primary transfer bias rollers 79Y, 79M, 79C, and 79K.

As the secondary transfer backup roller 82 drives and rotates the intermediate transfer belt 78 in the rotation direction R1, the intermediate transfer belt 78 passes through the primary transfer nips formed between the photoconductive drums 5Y, 5M, 5C, and 5K and the intermediate transfer belt 78 successively. Accordingly, the yellow, magenta, cyan, and black toner images formed on the photoconductive drums 5Y, 5M, 5C, and 5K are primarily transferred onto the intermediate transfer belt 78 such that the yellow, magenta, cyan, and black toner images are superimposed on a same position on the intermediate transfer belt 78, thus forming the color toner image on the intermediate transfer belt 78. Thereafter, the color toner image formed on the intermediate transfer belt 78 reaches a secondary transfer nip formed between a secondary transfer bias roller 89 and the intermediate transfer belt 78.

As the color toner image formed on the intermediate transfer belt 78 moves through the secondary transfer nip, the secondary transfer bias roller 89 secondarily transfers the color toner image formed on the intermediate transfer belt 78 onto a recording medium P conveyed through the secondary transfer nip in a secondary transfer process.

After the secondary transfer process, the intermediate transfer belt cleaner 80 disposed opposite the intermediate transfer belt 78 collects residual toner failed to be transferred onto the recording medium P and therefore remaining on the intermediate transfer belt 78 therefrom.

The paper tray 12 situated in a lower portion of the image forming apparatus 1 loads a plurality of recording media P (e.g., transfer sheets) such that the plurality of recording media P is layered on the paper tray 12.

Next, a detailed description is given of conveyance of the recording medium P from the paper tray 12.

As a feed roller 97 is driven and rotated counterclockwise in FIG. 1, an uppermost recording medium P of the plurality of recording media P loaded on the paper tray 12 is conveyed to a roller nip formed between registration rollers 98*a* and 98*b*. As the recording medium P comes into contact with the registration rollers 98*a* and 98*b*, the registration rollers 98*a* and 98*b* that stop their rotation halt the recording medium P temporarily at the roller nip formed between the registration rollers 98*a* and 98*b*. At a time when the color toner image formed on the intermediate transfer belt 78 reaches the secondary transfer nip, the registration rollers 98*a* and 98*b* resume their rotation to feed the recording medium P to the secondary transfer nip. Hence, as the recording medium P travels through the secondary transfer nip, the color toner image formed on the intermediate transfer belt 78 is secondarily transferred onto the recording medium P.

Thereafter, the recording medium P bearing the color toner image is conveyed to the fixing device 20. As the recording medium P is conveyed between a fixing belt 21 and a pressing roller 31 of the fixing device 20, the fixing belt 21 and the pressing roller 31 apply heat and pressure to the recording medium P, fixing the color toner image on the recording medium P.

The recording medium P bearing the fixed color toner image is conveyed through output rollers 99*a* and 99*b* and discharged and stacked onto an outside of the image forming apparatus 1, that is, an output tray 100 disposed atop the image forming apparatus 1. Thus, a series of image forming processes performed by the image forming apparatus 1 is completed.

Figure 2:
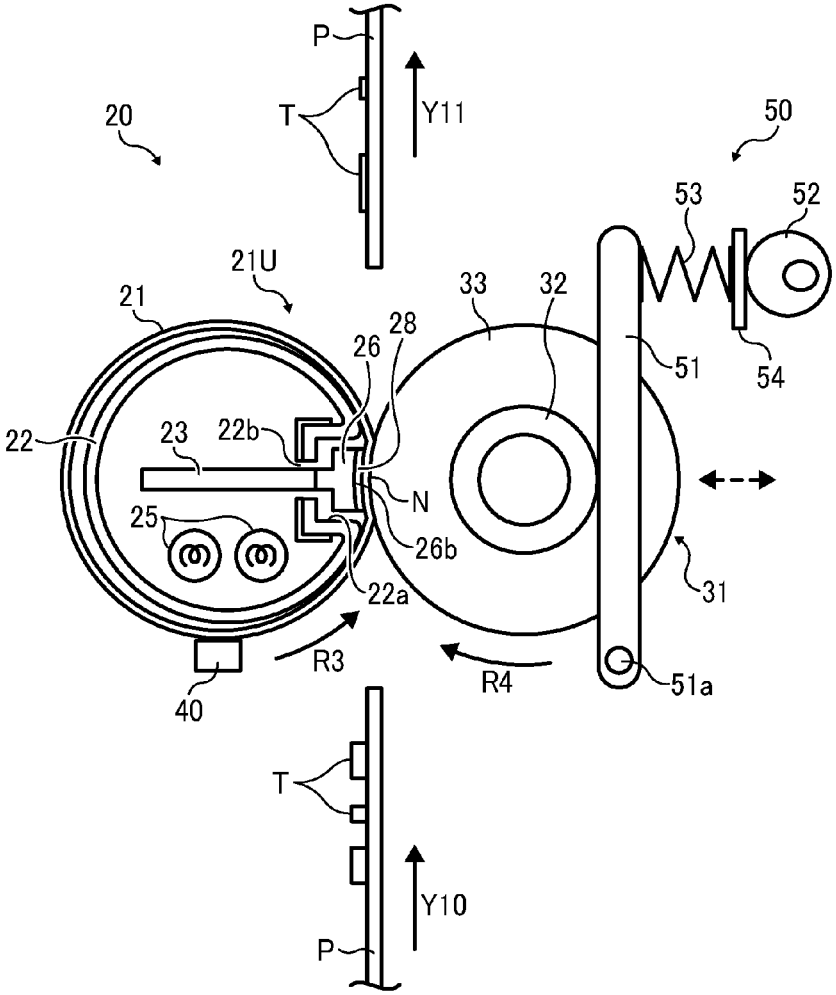
FIG. 2 is a vertical sectional view of a fixing device incorporated in the image forming apparatus shown in FIG. 1.
Figure 3:
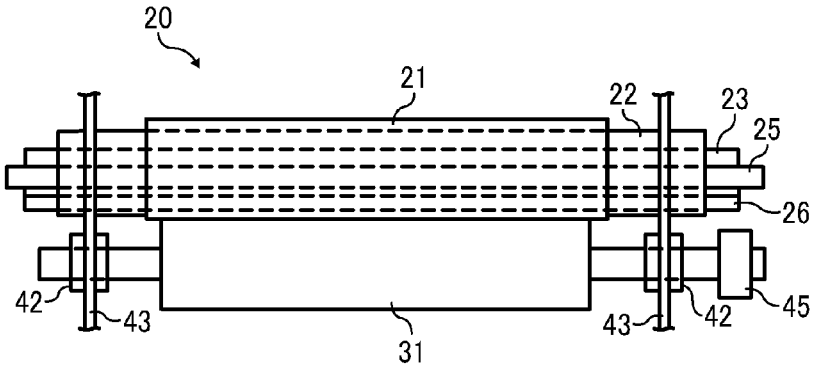
FIG. 3 is a side view of the fixing device shown in FIG. 2.

With reference to FIGS. 2 and 3, a description is provided of a construction of the fixing device 20 incorporated in the image forming apparatus 1 described above.

FIG. 2 is a vertical sectional view of the fixing device 20. FIG. 3 is a side view of the fixing device 20.

As shown in FIG. 2, the fixing device 20 (e.g., a fuser) includes the fixing belt 21 serving as an endless belt formed into a loop and rotatable in a rotation direction R3; a thermal conductor 22 disposed opposite an inner circumferential surface of the fixing belt 21; a nip formation pad 26 disposed inside the loop formed by the fixing belt 21; a low-friction sheet 28 serving as a friction reducer sandwiched between the nip formation pad 26 and the fixing belt 21; a support 23 disposed inside the loop formed by the fixing belt 21 to contact and support the nip formation pad 26; a heater 25 disposed inside the loop formed by the fixing belt 21 to heat the fixing belt 21 through the thermal conductor 22; the pressing roller 31 serving as a pressing rotary body pressed against the nip formation pad 26 via the fixing belt 21 and the low-friction sheet 28 to form a fixing nip N between the pressing roller 31 and the fixing belt 21 and rotatable in a rotation direction R4 counter to the rotation direction R3 of the fixing belt 21; a temperature sensor 40 disposed opposite an outer circumferential surface of the fixing belt 21 to detect the temperature of the fixing belt 21; and a pressurization assembly 50 pressing the pressing roller 31 against the fixing belt 21. The fixing belt 21 and the components disposed inside the loop formed by the fixing belt 21, that is, the thermal conductor 22, the nip formation pad 26, the low-friction sheet 28, the support 23, and the heater 25, may constitute a belt unit 21 U separably coupled with the pressing roller 31.

A detailed description is now given of a construction of the fixing belt 21.

The fixing belt 21 is a thin, flexible endless belt rotatable counterclockwise in FIG. 2 in the rotation direction R3. It is to be noted that the "endless belt" defines a seamless belt produced by bonding both circumferential ends of the belt.

For example, the fixing belt 21, having a thickness of about 1 mm or smaller, is constructed of a base layer constituting the inner circumferential surface of the fixing belt 21; an elastic layer coating the base layer; and a surface release layer coating the elastic layer. However, the construction of the fixing belt 21 is not limited to the above.

The base layer, having a thickness in a range of from about 30 micrometers to about 50 micrometers, is made of metal such as nickel and stainless steel or resin such as polyimide. However, the configuration of the base layer of the fixing belt 21 is not limited to the above.

The elastic layer, having a thickness in a range of from about 100 micrometers to about 300 micrometers, is made of rubber such as silicone rubber, silicone rubber foam, and fluoro rubber. However, the configuration of the elastic layer of the fixing belt 21 is not limited to the above. The elastic layer absorbs slight surface asperities of the fixing belt 21 at the fixing nip N when the pressing roller 31 is pressed against the nip formation pad 26 via the fixing belt 21, facilitating even conduction of heat from the fixing belt 21 to a toner image T on a recording medium P passing through the fixing nip N. Accordingly, the elastic layer of the fixing belt 21 suppresses formation of an orange peel image on the recording medium P. The orange peel image defines a faulty toner image having many slight surface asperities.

The release layer, having a thickness in a range of from about 10 micrometers to about 50 micrometers, is made of tetrafluoroethylene-perfluoroalkylvinylether copolymer (PFA), polytetrafluoroethylene (PTFE), polyimide, polyether imide, polyether sulfone (PES), or the like. However, the configuration of the release layer of the fixing belt 21 is not limited to the above. The release layer facilitates separation of the toner image T on the recording medium P from the fixing belt 21. A loop diameter of the fixing belt 21 is in a range of from about 15 mm to about 120 mm. According to this example embodiment, an inner loop diameter of the fixing belt 21 is about 30 mm. However, the configuration of the release layer of the fixing belt 21 is not limited to the above. Separation facilitated by the release layer defines separation of substances adhered to each other that is performed readily.

A detailed description is now given of a configuration of the nip formation pad 26.

As shown in FIG. 2, the nip formation pad 26 made of heat resistant resin such as liquid crystal polymer has a nip formation face 26*b* disposed opposite the pressing roller 31 via the low-friction sheet 28 and the fixing belt 21. The nip formation face 26*b* is curved or concave with respect to the pressing roller 31 in cross-section in accordance with the curvature of the pressing roller 31, that is, a curve of the pressing roller 31 at the fixing nip N. Accordingly, the curved nip formation face 26*b* directs the recording medium P discharged from the fixing nip N along the curve of the pressing roller 31, facilitating separation of the recording medium P bearing the fixed toner image T from the fixing belt 21 and therefore preventing the recording medium P from adhering to the fixing belt 21.

As shown in FIG. 3, both lateral ends of the nip formation pad 26 in a longitudinal direction thereof parallel to an axial direction of the fixing belt 21 are mounted on and supported by side plates 43 of the fixing device 20, respectively. The nip formation pad 26 mounted on and supported by the side plates 43 is stationarily positioned at least in a recording medium conveyance direction Y10 depicted in FIG. 2, thus being secured to the side plates 43 without being driven and rotated.

The nip formation pad 26, while being housed by a recess 22*a* of the thermal conductor 22 that is disposed opposite the fixing nip N with a gap between the nip formation pad 26 and the recess 22*a* of the thermal conductor 22, presses the low-friction sheet 28 against the inner circumferential surface of the fixing belt 21. The low-friction sheet 28 prevents abrasion or wear of the nip formation pad 26 that may be caused by friction between the nip formation pad 26 and the fixing belt 21 sliding thereover. A detailed description of a construction of the nip formation pad 26 is deferred.

A detailed description is now given of a configuration of the thermal conductor 22.

As shown in FIG. 3, both lateral ends of the thermal conductor 22 in a longitudinal direction thereof parallel to the axial direction of the fixing belt 21 are mounted on and supported by the side plates 43 of the fixing device 20, respectively. The thermal conductor 22 is a tube or a pipe having a thickness not greater than about 0.2 mm. According to this example embodiment, the thermal conductor 22 has a thickness of about 0.1 mm. However, the configuration of the thermal conductor 22 is not limited to the above. For example, the thermal conductor 22 is made of heat conductive metal such as aluminum, iron, and stainless steel.

The thermal conductor 22 having a thickness not greater than about 0.2 mm improves heating efficiency for heating the fixing belt 21. The thermal conductor 22 is disposed in proximity to or in contact with the inner circumferential surface of the fixing belt 21 in a circumferential span other than the fixing nip N. Conversely, at the fixing nip N, the thermal conductor 22 creates the recess 22*a* accommodating the nip formation pad 26 and being produced with a slit 22*b*.

A gap in a range of from about 0 mm to about 1 mm is provided between the fixing belt 21 and the thermal conductor 22 in the circumferential span other than the fixing nip N at ambient temperature. However, the size of the gap between the fixing belt 21 and the thermal conductor 22 is not limited to the above. Accordingly, the fixing belt 21 slides over the thermal conductor 22 in an increased area, decelerating abrasion or wear of the fixing belt 21.

Additionally, the fixing belt 21 is not isolated from the thermal conductor 22 excessively, suppressing degradation in heating efficiency for heating the fixing belt 21. The thermal conductor 22 disposed in proximity to the fixing belt 21 maintains the substantially circular loop of the flexible fixing belt 21, preventing or reducing deformation of the fixing belt 21 and resultant wear of the fixing belt 21.

In order to reduce abrasion of the fixing belt 21 sliding over the thermal conductor 22, a lubricant such as fluorine grease is applied between the fixing belt 21 and the thermal conductor 22.

As the thermal conductor 22 is heated by radiation heat and light (hereinafter referred to as radiation heat) from the heater 25, the thermal conductor 22 in turn heats the fixing belt 21. That is, the heater 25 heats the thermal conductor 22 directly and the fixing belt 21 indirectly through the thermal conductor 22.

The heater 25 includes a halogen heater, a carbon heater, or the like. As shown in FIG. 3, both lateral ends of the heater 25 in a longitudinal direction thereof parallel to the axial direction of the fixing belt 21 are mounted on the side plates 43 of the fixing device 20, respectively. As shown in FIG. 2, the temperature sensor 40 disposed opposite the outer circumferential surface of the fixing belt 21 detects the temperature of the fixing belt 21. A controller, that is, a central processing unit (CPU), provided with a random-access memory (RAM) and a read-only memory (ROM), operatively connected to the temperature sensor 40 and the heater 25 controls the heater 25 based on the temperature of the outer circumferential surface of the fixing belt 21 detected by the temperature sensor 40. Thus, the controller controls the heater 25 to heat the fixing belt 21 to a desired fixing temperature at which the color toner image is fixed on the recording medium P. For example, the temperature sensor 40 includes a thermistor.

The heater 25 having the configuration described above heats the fixing belt 21 through the thermal conductor 22 substantially entirely in a circumferential direction of the fixing belt 21, not locally. For example, the heater 25 heats the fixing belt 21 through the thermal conductor 22 over substantially the entire circumferential span of the fixing belt 21 other than the fixing nip N. The heated fixing belt 21 conducts heat to the toner image T on the recording medium P from the outer circumferential surface of the fixing belt 21. Accordingly, even if the fixing device 20 is installed in the image forming apparatus 1, the fixing belt 21 is heated by the heater 25 through the thermal conductor 22 sufficiently, suppressing faulty fixing. The fixing belt 21 is heated efficiently with the relatively simple construction of the fixing device 20 described above, shortening a warm-up time taken to warm up the fixing device 20 to a desired temperature and a first print time taken to output the first recording medium P bearing the fixed toner image T upon receipt of a print job as well as downsizing the fixing device 20.

A detailed description is now given of a configuration of the support 23.

As shown in FIG. 2, the support 23 is stationarily situated inside the loop formed by the fixing belt 21 to support the nip formation pad 26 against pressure from the pressing roller 31. As shown in FIG. 3, an axial length of the support 23 is equivalent to that of the nip formation pad 26 in a longitudinal direction of the support 23 parallel to the axial direction of the fixing belt 21. Both lateral ends of the support 23 in the longitudinal direction thereof are mounted on and supported by the side plates 43 of the fixing device 20, respectively. The support 23 presses against the pressing roller 31 via the nip formation pad 26, the low-friction sheet 28, and the fixing belt 21, supporting the nip formation pad 26 against pressure from the pressing roller 31 at the fixing nip N and thereby protecting the nip formation pad 26 from substantial deformation by pressure from the pressing roller 31.

The support 23 is made of metal having a relatively great mechanical strength such as stainless steel and ferro-alloy that achieves the advantages of the support 23 described above to support the nip formation pad 26.

Optionally, if the heater 25 is a heater that heats the fixing belt 21 with radiation heat, such as a halogen heater, an opposed face of the support 23 disposed opposite the heater 25 may be coated with a heat insulator or finished with bright annealing (BA) or mirror polishing partially or entirely. Accordingly, the support 23 insulates itself from radiation heat from the heater 25 or reflects light radiated from the heater 25 toward the support 23 to the thermal conductor 22, thus utilizing radiation heat to heat the thermal conductor 22 and improving heating efficiency of the heat conductor 22 to heat the fixing belt 21.

A detailed description is now given of a construction of the pressing roller 31.

As shown in FIG. 2, the pressing roller 31 serving as a pressing rotary body contacts the outer circumferential surface of the fixing belt 21 at the fixing nip N. The pressing roller 31 having a diameter of about 30 mm is constructed of a heat-resistant, hollow metal core 32 and an elastic layer 33 coating the metal core 32. However, the construction of the pressing roller 31 is not limited to the above.

The pressing roller 31 is pressed against the nip formation pad 26 via the fixing belt 21 and the low-friction sheet 28 to form the desired fixing nip N between the pressing roller 31 and the fixing belt 21 through which the recording medium P is conveyed.

As shown in FIG. 3, the pressing roller 31 mounts a gear 45 engaging a gear train connected to a driver that drives and rotates the pressing roller 31 clockwise in FIG. 2 in the rotation direction R4. As shown in FIG. 3, both lateral ends of the pressing roller 31 in an axial direction thereof are rotatably supported by the side plates 43 through bearings 42, respectively.

The elastic layer 33 of the pressing roller 31 is made of silicone rubber foam, silicone rubber, fluoro rubber, or the like. A thin, surface release layer made of PFA, PTFE, or the like coats the elastic layer 33. If the elastic layer 33 of the pressing roller 31 is made of sponge such as silicone rubber foam, the pressing roller 31 exerts reduced pressure to the nip formation pad 26 at the fixing nip N, reducing bending of the nip formation pad 26. In this case, the elastic layer 33 discourages heat conduction from the fixing belt 21 to the pressing roller 31, improving heating efficiency for heating the fixing belt 21.

A detailed description is now given of a construction of the pressurization assembly 50.

As shown in FIG. 2, the pressurization assembly 50 separably presses the pressing roller 31 against the fixing belt 21. The pressurization assembly 50 includes a lever 51, an eccentric cam 52, a spring 53, and a spring mount plate 54. The lever 51 is pivotable about a shaft 51*a* situated at one end of the lever 51 in a longitudinal direction and mounted on the side plate 43 of the fixing device 20. A center of the lever 51 in the longitudinal direction thereof contacts the bearing 42 that bears the pressing roller 31 and movably engages an elongate hole produced in the side plate 43 of the fixing device 20. The spring 53 is anchored to another end of the lever 51 in the longitudinal direction thereof and the spring mount plate 54. The spring mount plate 54 contacts the eccentric cam 52. The eccentric cam 52 is rotatable by a driver (e.g., a motor).

During a fixing job, as the driver rotates the eccentric cam 52, the lever 51 rotates about the shaft 51*a*. When the eccentric cam 52 is at a pressurization position shown in FIG. 2, the lever 51 presses the pressing roller 31 against the fixing belt 21, forming the desired fixing nip N therebetween. Conversely, while a fixing job is not performed, for example, while the recording medium P is jammed between the pressing roller 31 and the fixing belt 21, the eccentric cam 52 rotates a half-turn from the pressurization position shown in FIG. 2, causing the lever 51 to isolate the pressing roller 31 from the fixing belt 21 or to press the pressing roller 31 against the fixing belt 21 with decreased pressure therebetween.

With reference to FIGS. 2 and 3, a description is provided of a fixing operation of the fixing device 20 having the configuration described above to fix a toner image T on a recording medium P.

As a power switch of the image forming apparatus 1 is turned on, power is supplied to the heater 25. Simultaneously, a driver drives and rotates the pressing roller 31 in the rotation direction R4. Accordingly, the fixing belt 21 rotates in the rotation direction R3 in accordance with rotation of the pressing roller 31 by friction therebetween at the fixing nip N. Alternatively, the driver may be connected to the fixing belt 21 to drive and rotate it or connected to both the pressing roller 31 and the fixing belt 21 to drive and rotate them. Thereafter, as a recording medium P conveyed from the paper tray 12 depicted in FIG. 1 reaches the secondary transfer nip, the secondary transfer bias roller 89 secondarily transfers a toner image T formed on the intermediate transfer belt 78 onto the recording medium P.

The recording medium P bearing the toner image T is conveyed in the recording medium conveyance direction Y10 while guided by a guide plate and enters the fixing nip N formed between the fixing belt 21 and the pressing roller 31 pressed against the fixing belt 21. As the recording medium P is conveyed through the fixing nip N, the recording medium P receives heat from the fixing belt 21 heated by the heater 25 through the heat conductor 22 and pressure from the pressing roller 31 and the fixing belt 21 pressed against the pressing roller 31 by the nip formation pad 26 supported by the support 23. Thus, the toner image T is fixed on the recording medium P by the heat and pressure. Thereafter, the recording medium P bearing the fixed toner image T is discharged from the fixing nip N and conveyed in a recording medium conveyance direction Y11.

With reference to FIGS. 4 to 7, a description is provided of a configuration of the nip formation pad 26, the low-friction sheet 28 serving as a friction reducer, and a clip 29 serving as a friction reducer fastener.

Figure 4:
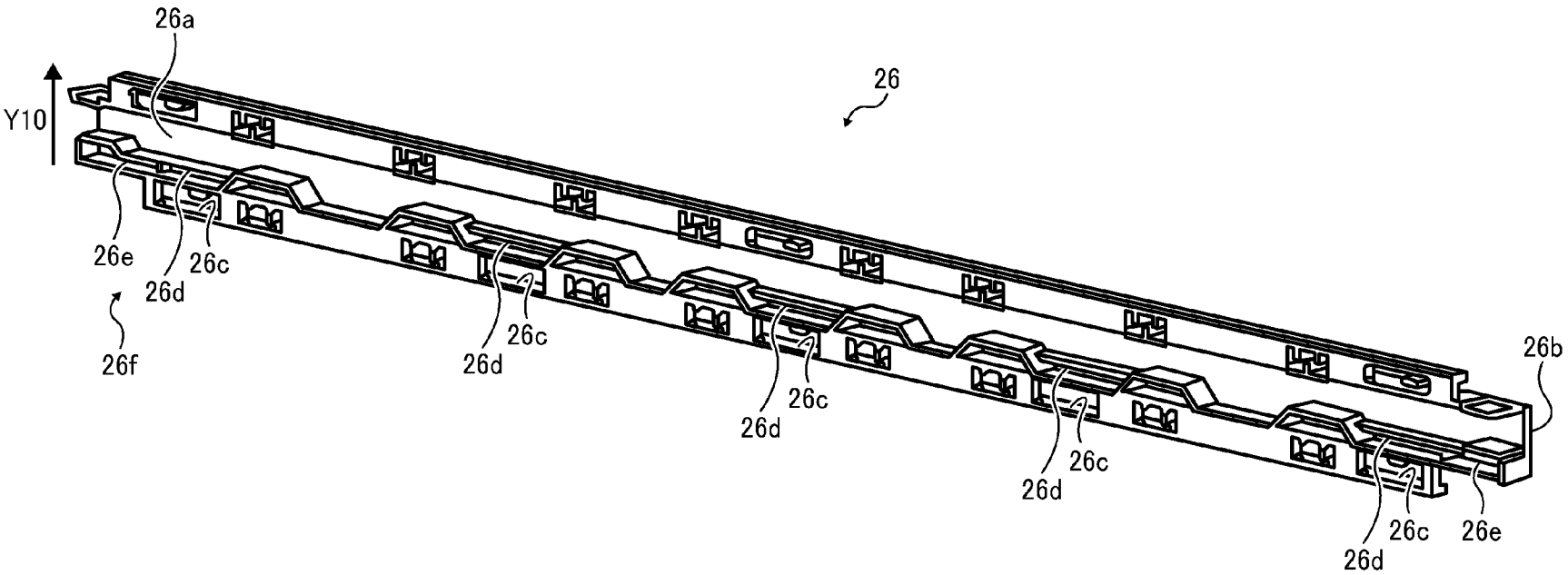
FIG. 4 is a perspective view of a nip formation pad incorporated in the fixing device shown in FIG. 2.
Figure 5:
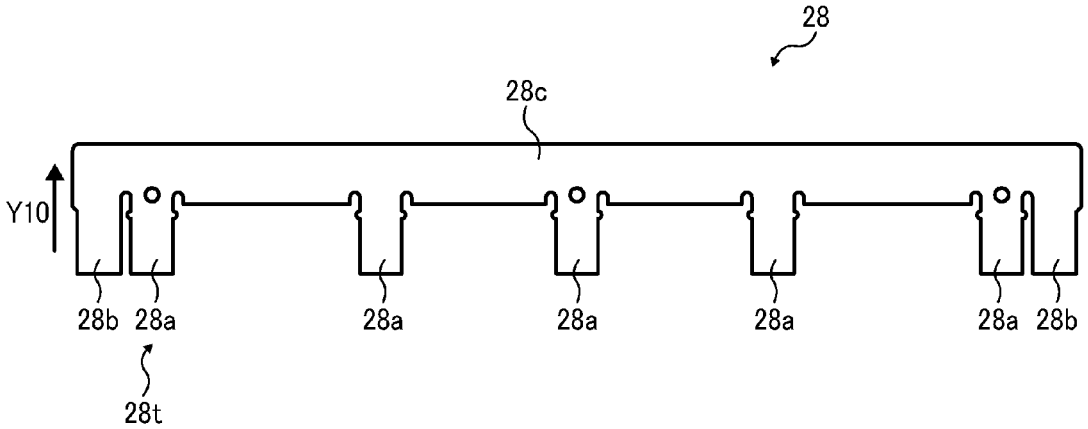
FIG. 5 is a plan view of a low-friction sheet incorporated in the fixing device shown in FIG. 2.
Figure 6:
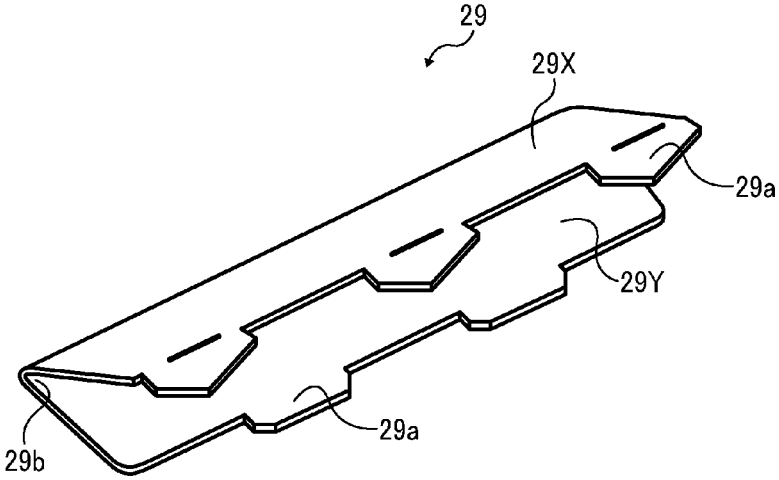
FIG. 6 is a perspective view of a clip attachable to the low-friction sheet shown in FIG. 5.
Figure 7:
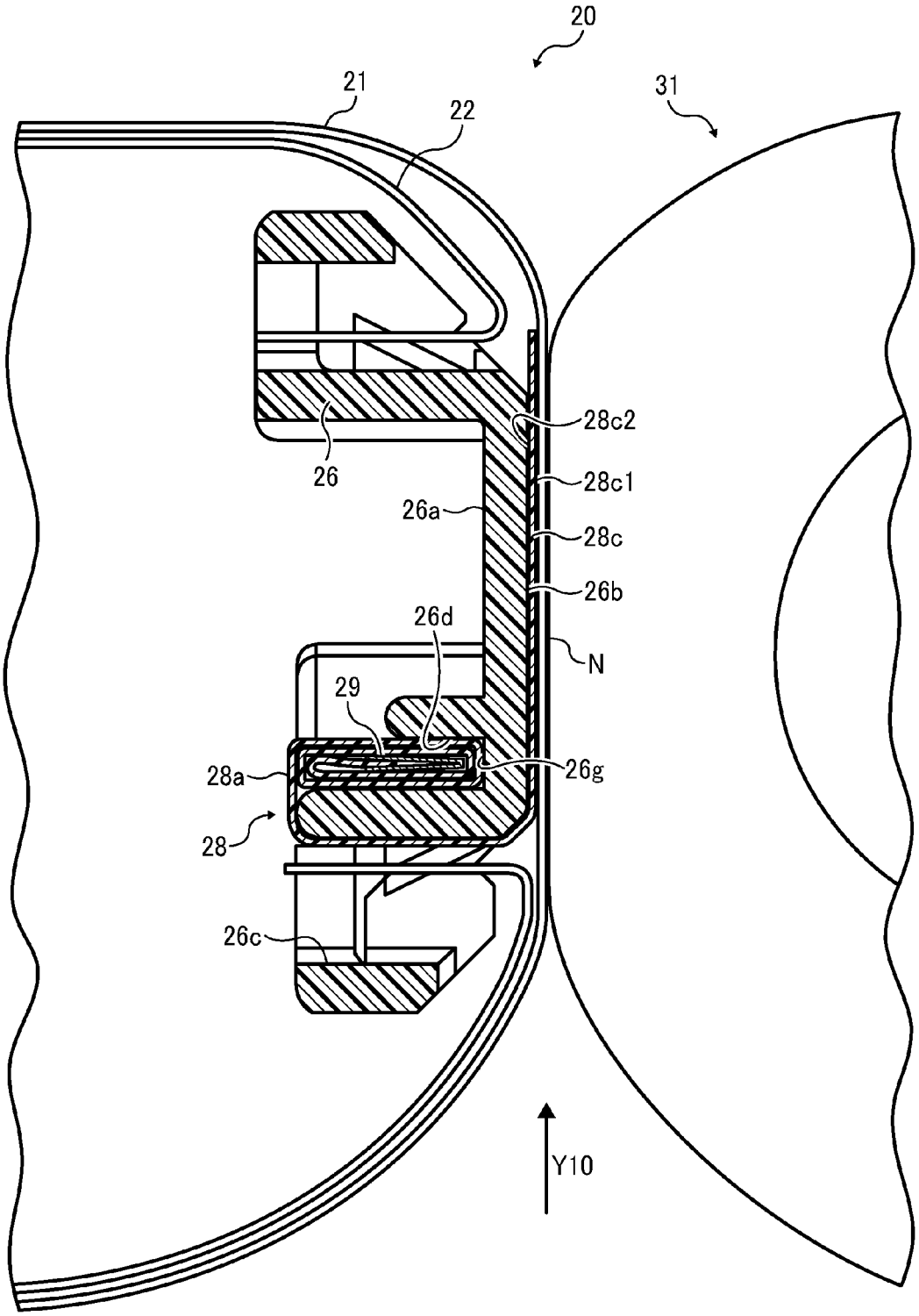
FIG. 7 is a partial vertical sectional view of the fixing device shown in FIG. 2 illustrating the nip formation pad and the low-friction sheet incorporated therein.

FIG. 4 is a perspective view of the nip formation pad 26. FIG. 5 is a plan view of the low-friction sheet 28. FIG. 6 is a perspective view of the clip 29. FIG. 7 is a partial vertical sectional view of the fixing device 20 illustrating the nip formation pad 26 and the low-friction sheet 28.

A detailed description is now given of a construction of the nip formation pad 26.

As shown in FIG. 4, the nip formation pad 26 includes a supported face 26*a*, the nip formation face 26*b*, a plurality of through-holes 26*c*, a plurality of inboard slots 26*d*, and a plurality of outboard slots 26*e*. The inboard slots 26*d* and the outboard slots 26*e* constitute a slot set 26*f* (e.g., a groove set).

The supported face 26*a* is contacted and supported by the support 23 depicted in FIG. 2 throughout substantially the entire axial span in the longitudinal direction of the nip formation pad 26. The supported face 26*a* is formed with a plurality of recesses contacting the support 23 to stationarily position the support 23 and the nip formation pad 26 in the recording medium conveyance direction Y10. Accordingly, even if the nip formation pad 26 receives pressure from the pressing roller 31 as the pressing roller 31 presses the fixing belt 21 against the nip formation pad 26, the nip formation pad 26 is supported by the support 23 at the supported face 26*a* of the nip formation pad 26 contacting the support 23, being immune from substantial deformation.

As shown in FIG. 2, the nip formation face 26*b* of the nip formation pad 26 that contacts the low-friction sheet 28 presses against the pressing roller 31 via the low-friction sheet 28 and the fixing belt 21 to form the fixing nip N between the fixing belt 21 and the pressing roller 31. As shown in FIG. 4, the plurality of through-holes 26*c* is produced in an upstream portion in the recording medium conveyance direction Y10, that is, a lower portion in FIG. 4, of the nip formation pad 26. That is, the through-holes 26*c* are situated upstream from the inboard slots 26*d* in the recording medium conveyance direction Y10. In order to mount the low-friction sheet 28 on the nip formation pad 26, an inboard tab 28*a* depicted in FIG. 5 of the low-friction sheet 28 is inserted through each through-hole 26*c* of the nip formation pad 26.

The inboard slots 26*d* and the outboard slots 26*e* are produced in an opposite face 26*g* depicted in FIG. 7 that is opposite the nip formation face 26*b* in the upstream portion in the recording medium conveyance direction Y10, that is, the lower portion in FIG. 4, of the nip formation pad 26. The inboard tab 28*a* depicted in FIG. 5 of the low-friction sheet 28 is inserted into and accommodated inside each inboard slot 26*d* of the nip formation pad 26 depicted in FIG. 4. Thus, the low-friction sheet 28 is mounted on the nip formation pad 26.

An outboard tab 28*b* depicted in FIG. 5 of the low-friction sheet 28 is inserted into and accommodated inside each outboard slot 26*e* of the nip formation pad 26 depicted in FIG. 4. Thus, the low-friction sheet 28 is mounted on the nip formation pad 26. Accordingly, the low-friction sheet 28 is mounted on the nip formation pad 26 readily with the simple structure and assembly of the fixing device 20. The inboard tab 28*a* and the outboard tab 28*b* of the low-friction sheet 28 are accommodated inside the inboard slot 26*d* and the outboard slot 26*e* of the nip formation pad 26, respectively, that are situated in proximity to the fixing nip N, occupying a decreased space that downsizes the fixing device 20.

A detailed description is now given of a configuration of the low-friction sheet 28.

The low-friction sheet 28 is made of a material having a decreased surface friction coefficient and a resistance against abrasion and heat such as porous fluoroplastic sheet fabric. As shown in FIG. 5, the low- friction sheet 28 is substantially rectangular and constructed of a body 28*c* in contact with the fixing belt 21 and the nip formation pad 26; the outboard tabs 28*b* projecting from both lateral ends of the body 28*c* in a longitudinal direction of the low-friction sheet 28 parallel to the axial direction of the fixing belt 21; and the inboard tabs 28*a* situated inboard from the outboard tabs 28*b* in the longitudinal direction of the low-friction sheet 28. The inboard tabs 28*a* and the outboard tabs 28*b* constitute a tab set 28*t* situated at an upstream end of the low-friction sheet 28 in the recording medium conveyance direction Y10.

The low-friction sheet 28 is constructed of a base layer made of porous fluoroplastic textile fabric and a polyethylene terephthalate (PET) resin sheet wrapped around the base layer and constituting a slide face 28*c*1 depicted in FIG. 7 of the body 28*c* that contacts the fixing belt 21. Alternatively, the low-friction sheet 28 may be a PTFE resin sheet manufactured by sinter molding, a glass fiber sheet impregnated with Teflon®, or the like. The low-friction sheet 28 has resistance to infiltration of a lubricant applied on the inner circumferential surface of the fixing belt 21 to prevent the lubricant from adhering to the nip formation face 26*b* of the nip formation pad 26.

As shown in FIG. 5, the substantially rectangular, five inboard tabs 28*a* are situated upstream from the body 28*c* in the recording medium conveyance direction Y10. The substantially rectangular, outboard tabs 28*b* are situated upstream from the body 28*c* in the recording medium conveyance direction Y10 and project from both lateral ends of the body 28*c* in the longitudinal direction of the low-friction sheet 28.

The substantially rectangular body 28*c* has a length greater than that of the nip formation face 26*b* depicted in FIG. 4 in the recording medium conveyance direction Y10. As shown in FIG. 7, the slide face 28*c*1 of the body 28*c* contacts the inner circumferential surface of the fixing belt 21. Conversely, an inner face 28*c*2 opposite the slide face 28*c*1 contacts the nip formation face 26*b* of the nip formation pad 26.

The slide face 28*c*1 of the body 28*c* of the low-friction sheet 28 that contacts the fixing belt 21 is produced with slight surface asperities that store the lubricant received from the inner circumferential surface of the fixing belt 21. For example, the slight surface asperities of the slide face 28*c*1 are defined by an arithmetic average roughness Ra in a range of from about 5 micrometers to about 30 micrometers. However, the configuration of the slide face 28*c*1 of the body 28*c* of the low-friction sheet 28 is not limited to the above.

If the arithmetic average roughness Ra of the slide face 28*c*1 is smaller than about 5 micrometers, the slide face 28*c*1 may catch the lubricant insufficiently. Conversely, if the arithmetic average roughness Ra of the slide face 28*c*1 is greater than about 30 micrometers, when an overhead projector (OHP) transparency or coated paper is used as a recording medium P, the surface asperities of the slide face 28*c*1 may be transferred onto the toner image T on the recording medium P through the fixing belt 21 and may appear on the recording medium P as the fixed toner image T of varied glosses. To address this circumstance, the slide face 28*c*1 has the arithmetic average roughness Ra in a range of from about 5 micrometers to about 30 micrometers that allows the slide face 28*c*1 to store the lubricant sufficiently and prohibits the slide face 28*c*1 from producing varied glosses on the fixed toner image T on the recording medium P.

A part of the slide face 28*c*1 of the low-friction sheet 28 over which the fixing belt 21 slides is applied with the lubricant to decrease frictional resistance between the nip formation pad 26 and the fixing belt 21. Accordingly, the low-friction sheet 28 decreasing frictional resistance between the nip formation pad 26 and the fixing belt 21 reduces abrasion or wear of the nip formation pad 26 and the fixing belt 21. Further, even if the fixing belt 21 slides over the low-friction sheet 28 frictionally, the low-friction sheet 28 may not be twisted or skewed.

A detailed description is now given of a construction of the clip 29.

As shown in FIG. 6, the clip 29 is manufactured by bending a resilient metal plate at an acute angle. The clip 29 is constructed of a first arm 29X produced with three pawls 29*a*; a second arm 29Y produced with two pawls 29*a*; and an abutment portion 29*b* that comes into contact with an upstream edge of the inboard tab 28*a* and the outboard tab 28*b* of the low-friction sheet 28 depicted in FIG. 5.

As the upstream edge of the inboard tab 28*a* and the outboard tab 28*b* of the low-friction sheet 28 comes into contact with the abutment portion 29*b* of the clip 29, the abutment portion 29*b* halts and positions the inboard tab 28*a* and the outboard tab 28*b* of the low-friction sheet 28. The pawls 29*a* of the clip 29 are bent to pinch the inboard tab 28*a* and the outboard tab 28*b* of the low-friction sheet 28. Thus, the clip 29 is mounted on each of the inboard tab 28*a* and the outboard tab 28*b* of the low-friction sheet 28.

With reference to FIG. 7, a description is provided of a method for mounting the low-friction sheet 28 on the nip formation pad 26.

It is to be noted that although the description below refers to the single inboard tab 28*a*, it is also applicable to the other inboard tabs 28*a*. A method for attaching the outboard tabs 28*b* to the nip formation pad 26 is identical to a method for attaching the inboard tabs 28*a* to the nip formation pad 26 except that the outboard tabs 28*b* do not penetrate the through-holes 26*c* of the nip formation pad 26.

First, as the upstream edge of the inboard tab 28*a* of the low-friction sheet 28 comes into contact with the abutment portion 29*b* of the clip 29 depicted in FIG. 6, the abutment portion 29*b* of the clip 29 halts and positions the inboard tab 28*a* of the low-friction sheet 28. The pawls 29*a* of the clip 29 are bent to pinch the inboard tab 28*a* of the low-friction sheet 28. Thus, the clip 29 is attached to an upstream end of the inboard tab 28*a* of the low-friction sheet 28. Next, the inboard tab 28*a* of the low-friction sheet 28 that is pinched with the clip 29 penetrates the through-hole 26*c* of the nip formation pad 26. Thereafter, the inboard tab 28*a* is wound around the clip 29 pinching the upstream end of the inboard tab 28*a* for a given number of times.

As shown in FIG. 7, the inboard tab 28*a* of the low-friction sheet 28 that is wound around the clip 29 for the given number of times is inserted into and accommodated inside the inboard slot 26*d* of the nip formation pad 26. Thus, the inboard tab 28*a* of the low-friction sheet 28 is mounted on the nip formation pad 26 at the inboard slot 26*d* situated at an upstream portion of the nip formation pad 26 in the recording medium conveyance direction Y10. Accordingly, the low-friction sheet 28 is attached to the nip formation pad 26 at a position in proximity to the fixing nip N with the compact, simple structure of the fixing device 20, facilitating assembly of the fixing device 20 while occupying a decreased space for installation of the fixing device 20 and therefore downsizing the fixing device 20.

The body 28*c* of the low-friction sheet 28 is interposed between and abutted by the nip formation face 26*b* of the nip formation pad 26 and the inner circumferential surface of the fixing belt 21. Hence, the low-friction sheet 28 is mounted on the nip formation pad 26 as it receives pressure exerted by the pressing roller 31 to press the fixing belt 21 against the nip formation pad 26 via the low-friction sheet 28.

As shown in FIGS. 4, 5, and 7, the inboard tabs 28*a* projecting from a center of the body 28*c* in the longitudinal direction of the low-friction sheet 28 are inserted into the inboard slots 26*d* of the nip formation pad 26, respectively; the outboard tabs 28*b* projecting from both lateral ends of the body 28*c* in the longitudinal direction of the low-friction sheet 28 are inserted into the outboard slots 26*e* of the nip formation pad 26, respectively.

The pressing roller 31 presses the fixing belt 21 and the low-friction sheet 28 against the nip formation face 26*b* of the nip formation pad 26. Accordingly, the pressing roller 31 rotates in the rotation direction R4 depicted in FIG. 2 while the fixing belt 21 and the low-friction sheet 28 are sandwiched between the pressing roller 31 and the nip formation pad 26.

The low-friction sheet 28 sandwiched between the pressing roller 31 and the nip formation pad 26, as it receives frictional resistance from the fixing belt 21, does not receive stress concentrated on a particular point. Accordingly, the low-friction sheet 28 reduces frictional resistance between the fixing belt 21 and the nip formation pad 26 while the low-friction sheet 28 is sandwiched between the fixing belt 21 and the nip formation pad 26 precisely. The low-friction sheet 28 that reduces frictional resistance between the fixing belt 21 and the nip formation pad 26 decreases a driving torque to rotate the fixing belt 21. Accordingly, the low-friction sheet 28 prevents formation of a faulty toner image fixed on the recording medium P that may arise due to slippage of the fixing belt 21 and abrasion or wear of a tooth flank of a gear connected to the pressing roller 31 to drive and rotate the pressing roller 31.

If the length of the fixing nip N formed between the pressing roller 31 and the fixing belt 21 is increased in the recording medium conveyance direction Y10 and the pressing roller 31 exerts increased pressure to the fixing belt 21 as the fixing device 20 is configured to convey the recording medium P at high speed, the inner circumferential surface of the fixing belt 21 may slide over the nip formation face 26*b* of the nip formation pad 26 for an extended period of time. To address this circumstance, the low-friction sheet 28 interposed between the fixing belt 21 and the nip formation pad 26 reduces friction between the fixing belt 21 and the nip formation pad 26, suppressing abrasion or wear of the fixing belt 21 and the nip formation pad 26.

A description is provided of advantages of the fixing device 20.

As shown in FIG. 2, the fixing device 20 includes the fixing belt 21 serving as an endless belt formed into a loop produced by bonding both ends thereof. The heater 25 is disposed inside the loop formed by the fixing belt 21. The pressing roller 31 serving as a pressing rotary body separably contacts the fixing belt 21 and is rotatable while contacting the fixing belt 21. The nip formation pad 26, disposed inside the loop formed by the fixing belt 21 such that the nip formation pad 26 is disposed opposite the inner circumferential surface of the fixing belt 21, presses the fixing belt 21 against the pressing roller 31 to form the fixing nip N between the fixing belt 21 and the pressing roller 31. The low-friction sheet 28, serving as a friction reducer disposed inside the loop formed by the fixing belt 21 and sandwiched between the fixing belt 21 and the nip formation pad 26, reduces frictional resistance between the nip formation pad 26 and the fixing belt 21 sliding thereover. As the recording medium P bearing the toner image T is conveyed through the fixing nip N, the fixing belt 21 and the pressing roller 31 apply heat and pressure to the recording medium P, fixing the toner image T on the recording medium P. As shown in FIG. 5, the low-friction sheet 28 includes a tab (e.g., the inboard tabs 28*a* and the outboard tabs 28*b*) projecting from the body 28*c* in the direction opposite the recording medium conveyance direction Y10. The clip 29 serving as a friction reducer fastener is attached to the tab and placed inside the nip formation pad 26 to mount the low-friction sheet 28 on the nip formation pad 26.

Accordingly, the low-friction sheet 28 is fixedly provided between the fixing belt 21 and the nip formation pad 26 with the compact, simple structure of the fixing device 20, reducing friction between the nip formation pad 26 and the fixing belt 21 sliding thereover.

A description is now given of the advantages of the fixing device 20 in detail.

As shown in FIG. 2, the fixing belt 21 is an endless belt produced by bonding both ends and accommodating the heater 25. The pressing roller 31 rotates in the rotation direction R4 while contacting the fixing belt 21. The nip formation pad 26 disposed opposite the inner circumferential surface of the fixing belt 21 presses the fixing belt 21 against the pressing roller 31 to form the fixing nip N between the fixing belt 21 and the pressing roller 31. The low-friction sheet 28 disposed opposite the inner circumferential surface of the fixing belt 21 is interposed between the fixing belt 21 and the nip formation pad 26 to reduce frictional resistance between the nip formation pad 26 and the fixing belt 21 sliding thereover. As the recording medium P bearing the toner image T is conveyed through the fixing nip N, the fixing belt 21 and the pressing roller 31 apply heat and pressure to the recording medium P, fixing the toner image T on the recording medium P.

As shown in FIG. 5, the low-friction sheet 28 includes the inboard tabs 28*a* and the outboard tabs 28*b* projecting from the body 28*c* in a direction opposite the recording medium conveyance direction Y10. The clips 29 depicted in FIG. 6 pinching the inboard tabs 28*a* and the outboard tabs 28*b* are placed in the inboard slots 26*d* and the outboard slots 26*e* of the nip formation pad 26 depicted in FIG. 4, respectively, thus mounting the low-friction sheet 28 on the nip formation pad 26. Accordingly, the low-friction sheet 28 is attached to the nip formation pad 26 with the compact, simple structure of the fixing device 20, facilitating assembly of the fixing device 20 while occupying a decreased space for installation of the fixing device 20 and therefore downsizing the fixing device 20.

The low-friction sheet 28 that reduces frictional resistance between the fixing belt 21 and the nip formation pad 26 decreases the driving torque to rotate the fixing belt 21. Accordingly, the low-friction sheet 28 prevents formation of a faulty toner image fixed on the recording medium P that may arise due to slippage of the fixing belt 21 and abrasion or wear of the tooth flank of the gear connected to the pressing roller 31 to drive and rotate the pressing roller 31.

The low-friction sheet 28 decreasing frictional resistance between the nip formation pad 26 and the fixing belt 21 reduces abrasion or wear of the nip formation pad 26 and the fixing belt 21. Accordingly, even if the length of the fixing nip N formed between the pressing roller 31 and the fixing belt 21 is increased in the recording medium conveyance direction Y10 and the pressing roller 31 exerts increased pressure to the fixing belt 21 as the fixing device 20 is configured to convey the recording medium P at high speed, the low-friction sheet 28 interposed between the fixing belt 21 and the nip formation pad 26 reduces friction between the fixing belt 21 and the nip formation pad 26, suppressing abrasion or wear of the fixing belt 21 and the nip formation pad 26.

As shown in FIG. 5, the inboard tabs 28*a* and the outboard tabs 28*b* of the low-friction sheet 28 project from the body 28*c* in the direction opposite the recording medium conveyance direction Y10, that is, upstream in the recording medium conveyance direction Y10. As the clips 29 pinching the inboard tabs 28*a* and the outboard tabs 28*b* of the low-friction sheet 28 are placed in the inboard slots 26*d* and the outboard slots 26*e* of the nip formation pad 26, respectively, the low-friction sheet 28 is mounted on the nip formation pad 26.

As shown in FIG. 5, the plurality of inboard tabs 28*a* and the plurality of outboard tabs 28*b* are aligned in the longitudinal direction of the low-friction sheet 28. Accordingly, the low-friction sheet 28 is attached to the nip formation pad 26 with the compact, simple structure of the fixing device 20, facilitating assembly of the fixing device 20 while occupying a decreased space for installation of the fixing device 20 and therefore downsizing the fixing device 20.

The clips 29 pinching the inboard tabs 28*a* and the outboard tabs 28*b* of the low-friction sheet 28 are inserted into the inboard slots 26*d* and the outboard slots 26*e* of the nip formation pad 26, respectively. As the clips 29 wound with the inboard tabs 28*a* and the outboard tabs 28*b* of the low-friction sheet 28 are inserted into the inboard slots 26*d* and the outboard slots 26*e* of the nip formation pad 26, respectively, the low-friction sheet 28 is mounted on the nip formation pad 26. Accordingly, the low-friction sheet 28 is attached to the nip formation pad 26 with the compact, simple structure of the fixing device 20, facilitating assembly of the fixing device 20 while occupying a decreased space for installation of the fixing device 20 and therefore downsizing the fixing device 20.

As shown in FIG. 7, the opposite face 26*g* of the nip formation pad 26 opposite the nip formation face 26*b* pressing the fixing belt 21 against the pressing roller 31 to form the fixing nip N between the fixing belt 21 and the pressing roller 31 is produced with the inboard slots 26*d* and the outboard slots 26*e*. Accordingly, the low-friction sheet 28 is attached to the nip formation pad 26 at a position in proximity to the fixing nip N with the compact, simple structure of the fixing device 20, occupying a decreased space for installation of the fixing device 20 and therefore downsizing the fixing device 20.

The low-friction sheet 28 is porous. Accordingly, the low-friction sheet 28 decreases frictional resistance between the nip formation pad 26 and the fixing belt 21, reducing abrasion or wear of the nip formation pad 26 and the fixing belt 21. Further, even if the fixing belt 21 slides over the low-friction sheet 28 frictionally, the low-friction sheet 28 may not be twisted or skewed.

The body 28*c* of the low-friction sheet 28 contacts the inner circumferential surface of the fixing belt 21 and the nip formation face 26*b* of the nip formation pad 26. At least a part of the body 28*c* of the low-friction sheet 28 is applied with a lubricant. Accordingly, the low-friction sheet 28 reduces frictional resistance between the fixing belt 21 and the nip formation pad 26, suppressing abrasion or wear of the nip formation pad 26 and the fixing belt 21 sliding thereover. Further, even if the fixing belt 21 slides over the low-friction sheet 28 frictionally, the low-friction sheet 28 may not be twisted or skewed.

As shown in FIG. 2, the heater 25 is situated inside the thermal conductor 22 disposed opposite the inner circumferential surface of the fixing belt 21. The thermal conductor 22 conducts radiation heat received from the heater 25 to the fixing belt 21. Since the fixing belt 21 is not heated by the heater 25 directly, the fixing belt 21 is made of low-cost resin. Hence, the fixing belt 21 is manufactured at reduced costs.

The fixing belt 21 is heated efficiently with the relatively simple construction of the fixing device 20 described above, shortening the warm-up time taken to warm up the fixing device 20 and the first print time taken to output the first recording medium P bearing the fixed toner image T upon receipt of a print job as well as downsizing the fixing device 20.

A description is provided of alternative configurations of the components incorporated in the fixing device 20 described above.

According to the example embodiments described above, the lubricant is applied between the thermal conductor 22 and the fixing belt 21. Alternatively, an outer circumferential surface of the thermal conductor 22 over which the inner circumferential surface of the fixing belt 21 slides may be made of a material having a decreased friction coefficient. Yet alternatively, a surface layer made of a fluorine material may constitute the inner circumferential surface of the fixing belt 21.

According to the example embodiments described above, the nip formation pad 26 is substantially U-shaped in cross-section as shown in FIG. 7. Alternatively, the nip formation pad 26 may be planar or a plane contiguous to U-shape.

The nip formation pad 26 creating the fixing nip N substantially parallel to the imaged side of the recording medium P prevents the recording medium P from creasing. As the nip formation pad 26 is formed into U-shape in cross-section, the nip formation pad 26 facilitates adhesion of the fixing belt 21 to the recording medium P, improving fixing quality for fixing the color toner image T on the recording medium P.

Additionally the planar fixing nip N increases the curvature of the fixing belt 21 at an exit of the fixing nip N, facilitating separation of the recording medium P discharged from the fixing nip N from the fixing belt 21.

According to the example embodiments described above, a halogen heater is used as the heater 25. Alternatively, an induction heater may be used as the heater 25, for example.

According to the example embodiments described above, the thermal conductor 22 is substantially circular in cross-section. Alternatively, the thermal conductor 22 may be polygonal. In order to heat the fixing belt 21 more efficiently with the relatively simple construction of the fixing device 20, the thermal conductor 22 may be eliminated and a heater may heat the fixing belt 21 directly. In this case, since the total heat capacity of the fixing device 20 is reduced by the heat capacity of the eliminated thermal conductor 22, the fixing device 20 is heated more quickly, saving energy and downsizing the fixing device 20. Since the fixing belt 21 is requested to be thermally resistive, it is preferable that the base layer of the fixing belt 21 is made of metal such as nickel and stainless steel.

According to the example embodiments described above, no heater is situated inside the metal core 32 of the pressing roller 31 as shown in FIG. 2. Alternatively, a heater such as a halogen heater may be situated inside the pressing roller 31.

According to the exemplary embodiments described above, the loop diameter of the fixing belt 21 is equivalent to the diameter of the pressing roller 31. Alternatively, the loop diameter of the fixing belt 21 may be smaller than the diameter of the pressing roller 31. In this case, the curvature of the fixing belt 21 at the fixing nip N is greater than that of the pressing roller 31, facilitating separation of the recording medium P discharged from the fixing nip N from the fixing belt 21. Yet alternatively, the loop diameter of the fixing belt 21 may be greater than the diameter of the pressing roller 31. According to the exemplary embodiments described above, regardless of a relation between the loop diameter of the fixing belt 21 and the diameter of the pressing roller 31, the thermal conductor 22 does not receive pressure from the pressing roller 31.

According to the example embodiments described above, the shape of the inboard slot 26*d* is different from that of the outboard slot 26*e* as shown in FIG. 4. Alternatively, the shape of the inboard slot 26*d* may be identical to that of the outboard slot 26*e*.

According to the example embodiments described above, the shape of the inboard tab 28*a* is different from that of the outboard tab 28*b* as shown in FIG. 5. Alternatively, the shape of the inboard tab 28*a* may be identical to that of the outboard tab 28*b*. The clip 29 is attached to each of the inboard tabs 28*a* and the outboard tabs 28*b*. Alternatively, the clip 29 may be attached to selected ones of the inboard tabs 28*a* and the outboard tabs 28*b* sufficient enough to mount the low-friction sheet 28 on the nip formation pad 26.

According to the example embodiments described above, the low-friction sheet 28 includes the five inboard tabs 28*a* as shown in FIG. 5. However, the number of the inboard tabs 28*a* is not limited to five. It is to be noted that if the number of the inboard tabs 28*a* is changed to the number other than five, it is preferable that the inboard tabs 28*a* are symmetrical with respect to a center of the low-friction sheet 28 in the longitudinal direction thereof.

According to the example embodiments described above, as shown in FIG. 7, a downstream end of the low-friction sheet 28 in the recording medium conveyance direction Y10 is not mounted on the nip formation pad 26. Alternatively, the inboard tabs 28*a* and the outboard tabs 28h may also project from the body 28*c* in the recording medium conveyance direction Y10 at the downstream end of the low-friction sheet 28 so that the inboard tabs 28*a* and the outboard tabs 28*b* are placed in the inboard slots 26*d* and the outboard slots 26*e* both at the upstream end and at the downstream end of the low-friction sheet 28.

According to the example embodiments described above, as shown in FIG. 6, the three pawls 29*a* project from the first arm 29X of the clip 29; the two pawls 29*a* project from the second arm 29Y of the clip 29. Alternatively, the number of the pawls 29*a* may be changed to other numbers that allow the clip 29 to pinch each of the inboard tab 28*a* and the outboard tab 28*b*.

According to the example embodiments described above, the lubricant is applied to a part of the slide face 28*c*1 depicted in FIG. 7 of the body 28*c* of the low-friction sheet 28 that contacts the fixing belt 21. Alternatively, the lubricant may be applied to the inner face 28*c*2 of the body 28*c* of the low-friction sheet 28 that contacts the nip formation face 26*b* of the nip formation pad 26 or applied to both the slide face 28*c*1 and the inner face 28*c*2 of the body 28*c* of the low-friction sheet 28. Yet alternatively, the lubricant may be applied to the entire surface of the body 28*c* of the low-friction sheet 28.

According to the example embodiments described above, the fixing belt 21 serves as an endless belt. Alternatively, an endless film or the like may be used as an endless belt.

Further, the pressing roller 31 serves as a pressing rotary body. Alternatively, a pressing belt or the like may be used as a pressing rotary body.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A fixing device comprising:

an endless belt rotatable in a given direction of rotation;

a heater disposed opposite and heating the endless belt;

a pressing rotary body rotatable while contacting the endless belt;

a nip formation pad disposed opposite an inner circumferential surface of the endless belt and pressing the endless belt against the pressing rotary body to form a fixing nip between the endless belt and the pressing rotary body, the fixing nip through which a recording medium is conveyed;

a friction reducer sandwiched between the endless belt and the nip formation pad, the friction reducer over which the endless belt slides, the friction reducer including:

a body; and at least one tab projecting from the body in a direction opposite a recording medium conveyance direction; and a friction reducer fastener attached to the tab of the friction reducer and placed inside the nip formation pad to mount the friction reducer on the nip formation pad.

2. The fixing device according to claim 1, wherein the friction reducer fastener pinches the tab of the friction reducer.

3. An image forming apparatus comprising the fixing device according to claim 2.

4. The fixing device according to claim 1, wherein the at least one tab of the friction reducer includes a plurality of tabs aligned in a longitudinal direction of the friction reducer.

5. The fixing device according to claim 1, wherein the nip formation pad includes at least one slot into which the at least one tab of the friction reducer and the friction reducer fastener are inserted.

6. The fixing device according to claim 5, wherein the tab of the friction reducer is wound around the friction reducer fastener and inserted into the slot of the nip formation pad.

7. The fixing device according to claim 6, wherein the nip formation pad further includes:

a nip formation face contacting the friction reducer to press the friction reducer against the endless belt; and an opposed face opposite the nip formation face, the opposed face produced with the slot.

8. The fixing device according to claim 5, wherein the at least one tab of the friction reducer includes:

an outboard tab projecting from a lateral end of the body in a longitudinal direction of the friction reducer and pinched by the friction reducer fastener; and an inboard tab disposed inboard from the outboard tab in the longitudinal direction of the friction reducer and pinched by the friction reducer fastener.

9. The fixing device according to claim 8, wherein the at least one slot of the nip formation pad includes:

an outboard slot, disposed at a lateral end of the nip formation pad in a longitudinal direction thereof, into which the outboard tab of the friction reducer and the friction reducer fastener pinching the outboard tab are inserted; and an inboard slot, disposed inboard from the outboard slot in the longitudinal direction of the nip formation pad, into which the inboard tab of the friction reducer and the friction reducer fastener pinching the inboard tab are inserted.

10. The fixing device according to claim 9, wherein the nip formation pad further includes a through-hole disposed upstream from the inboard slot in the recording medium conveyance direction, and wherein the inboard tab of the friction reducer penetrates the through-hole of the nip formation pad.

11. The fixing device according to claim 8, wherein the friction reducer fastener pinches an upstream edge of each of the inboard tab and the outboard tab of the friction reducer in the recording medium conveyance direction.

12. The fixing device according to claim 1, wherein the friction reducer is porous.

13. The fixing device according to claim 1, wherein the friction reducer includes a low-friction sheet.

14. The fixing device according to claim 1, wherein the body of the friction reducer contacts the endless belt and the nip formation pad and a lubricant is applied to at least a part of the body of the friction reducer.

15. The fixing device according to claim 1, wherein the heater is disposed opposite the inner circumferential surface of the endless belt.

16. The fixing device according to claim 15, further comprising a thermal conductor disposed opposite the inner circumferential surface of the endless belt, wherein the heater is disposed opposite an inner circumferential surface of the thermal conductor to heat the endless belt through the thermal conductor.

17. The fixing device according to claim 1, wherein the friction reducer fastener includes a clip.

18. The fixing device according to claim 17, wherein the clip includes:

a plurality of pawls to pinch the tab of the friction reducer; and an abutment portion abutting an upstream edge of the tab in the recording medium conveyance direction.

19. The fixing device according to claim 1, wherein the pressing rotary body includes a pressing roller.

20. An image forming apparatus comprising the fixing device according to claim 1.

* * * * *